US005432311A

United States Patent [19]

Lin

[11] Patent Number: 5,432,311

[45] Date of Patent: Jul. 11, 1995

[54] COMMON CONDUCTING UNIT FOR A CONTACT SWITCH

[75] Inventor: Ching-Chuan Lin, Hsin-Tien City,

[73] Assignee: Shin Jiuh Corp., Taipei Hsien, Taiwan

[21] Appl. No.: 161,572

[22] Filed: Dec. 6, 1993

[51] Int. Cl.[6] ..... H01H 13/28

[52] U.S. Cl. ..... 200/467

[58] Field of Search ..... 200/271, 272, 275, 451, 200/453, 454, 456, 457, 459, 461, 445, 460, 462, 467, 463

[56] References Cited

U.S. PATENT DOCUMENTS

| | | | |
|---|---|---|---|
| 2,594,216 | 4/1952 | Roeser | 200/461 |
| 3,033,953 | 5/1962 | Schwerke | 200/461 |
| 3,141,075 | 7/1964 | Brevick et al. | 200/467 |
| 3,476,898 | 11/1969 | Ehrenfels et al. | 200/461 |
| 3,571,541 | 3/1971 | Bedocs et al. | 200/462 |
| 4,673,778 | 6/1987 | Lewandowski et al. | 200/467 |
| 4,902,863 | 2/1990 | Fukuma | 200/459 |
| 5,016,140 | 5/1991 | Prestel et al. | 200/459 |
| 5,043,545 | 8/1991 | Yamashita et al. | 200/459 |

*Primary Examiner*—Renee S. Luebke

*Attorney, Agent, or Firm*—Sandler, Greenblum & Bernstein

[57] ABSTRACT

A common conducting unit for a contact switch includes a mounting plate that has an elongated flat portion with two parallel end edges, and first and second end plate portions extend integrally and perpendicularly from a respective one of the end edges in the same direction. The first end plate portion has an engaging groove formed therein and extends parallel to the end edges of the flat portion. A spring mounting portion extends integrally and perpendicularly from an end edge of the second end plate portion. A through-opening extends from a position adjacent to the end edge of the first end plate portion to a position adjacent to the end edge of the second end plate portion.

3 Claims, 3 Drawing Sheets

COMMON CONDUCTING UNIT FOR A CONTACT SWITCH

BACKGROUND OF THE INVENTION

1. Field of the Invention

The invention relates to a common conducting unit, more particularly to a common conducting unit for a contact switch.

2. Description of the Related Art

FIG. 1 shows an exploded view of a conventional common conducting unit which is to be employed in a contact switch (see FIG. 2). As best illustrated in FIG. 1, the conventional common conducting unit includes a mounting plate 12 having an elongated flat portion 121 with two parallel end edges 1211, 1212, first and second end plate portions 124, 128 extending integrally and perpendicularly from the respective one of the end edges 1211, 1212 in opposite directions. The first end plate portion 124 has an engaging groove 127 formed on an outward face thereof and is parallel with the end edges 1211, 1212 of the flat portion 121. A common conducting leg plate 15 is formed integrally with the second end plate portion 128 of the mounting plate 12 and extends in the same direction as the second end plate portion 128. A spring engaging plate 123 projects from a position which is adjacent to the second end plate portion 128 of the elongated flat portion 121 in the same direction as the first end plate portion 124. The mounting plate 12 further has an opening 129 which extends from a position adjacent to the spring engaging plate 123 to a position adjacent to the end edge of the first end plate portion 124. The spring engaging plate 123 has a mounting hole 126 formed therethrough and a top end portion which is provided with a notch 125. A movable contact plate 13 has a pair of spaced leg portions 132 abutting pivotally in the engaging groove 127 of the first end plate portion 124. The movable contact plate 13 has an engaging opening 131 formed therethrough. One end 141 of the spring member 14 is hooked to the spring engaging plate 123 between the notch 125 and the mounting hole 126. The other end 142 of the spring member 14 passes through the opening 129 and is hooked to the movable contact plate 13 at the engaging opening 131, thereby enabling the contact plate 13 to move between an upper and a lower position when the spring member 14 is actuated.

Referring to FIG. 2, the contact switch includes a switch casing 11, first and second conductors 17, 18, a button member 19 and a press lever 16. The first and second conductors 17, 18 have downwardly extending leg portions which project out of the switch casing 11 in the same direction as the common conducting leg plate 15. The first and second conductors 17 and 18 have contact portions which are disposed inside the switch casing 11 and which extend respectively above and below the movable contact plate 13. The button member 19 is in contact with the intermediate portion of the spring member 14. The press lever 16 is actuated to push the button member 19 downward to correspondingly move the movable contact plate 13 to the upper position, wherein the movable contact plate 13 is in contact with the first conductor 17, or to the lower position, wherein the movable contact plate 13 is in contact with the second conductor 18.

The main drawback of the above described conventional common conducting unit resides in the mounting of the spring member 14. Since the mounting hole 126 of the spring engaging plate 123 does not lie in the same orientation as that of the engaging opening 131 of the movable contact plate 13, full automation of the mounting procedure of the spring member 14 to interconnect the spring engaging plate 123 and the contact plate 13 is difficult, thereby resulting in waste of labor, a longer production time and normally in low production. In addition, manual mounting operation results in poorer quality.

SUMMARY OF THE INVENTION

The main objective of the present invention is to provide a common conducting unit for a contact switch which includes a spring mounting portion with a particular configuration that facilitates fully automated mounting of a spring member.

Accordingly, the common conducting unit of the present invention is to be employed in a contact switch and includes a mounting plate with an elongated flat portion that has two parallel end edges, first and second end plate portions that extend integrally and perpendicularly extend from a respective one of the end edges in the same direction, thereby forming a pair of opposed faces, a pair of outward faces and a pair of end edges. The outward face of the first end plate portion has an engaging groove formed therein and is parallel with the end edges of the elongated flat portion. A spring mounting portion extends integrally, outwardly and perpendicularly from the end edge of the second end plate portion and forms an end edge therewith. The mounting plate further has a through-opening which extends from a position adjacent to the end edge of the first end plate portion to a position adjacent to the end edge of the second end plate portion. A conducting leg plate extends integrally from the end edge of the spring mounting portion.

In one preferred embodiment, the conducting leg portion extends from the end edge of the spring mounting portion in the same direction as the spring mounting portion.

In another preferred embodiment, the conducting leg portion extends perpendicularly from the end edge of the spring mounting portion in a direction opposite to that of the end plate portions of the mounting plate.

With such a configuration, the common conducting unit of the present invention permits easy mounting of a contact plate thereto with the use of a tension spring. The contact plate has a first end with a pair of spaced leg portions which are to be engaged in the engaging groove of the first end plate portion of the mounting plate. The tension spring passes through the first end plate portion via the through-opening of the mounting plate so as to interconnect the contact plate and the spring mounting portion under tension such that the spaced leg portions of the contact plate abut pivotally against the engaging groove of the first end plate portion of the mounting plate.

Since the spring mounting portion has an engaging hole which lies in the same orientation as that of the engaging opening of the contact plate, mounting of the contact plate so as to abut pivotally in the engaging groove of the first end plate portion of the mounting plate by means of the tension spring can be done automatically by a machine.

BRIEF DESCRIPTION OF THE DRAWINGS

Other features and advantages of the present invention will become more apparent in the following detailed description of the preferred embodiments with reference to the accompanying drawings, in which.

DETAILED DESCRIPTION OF THE PREFERRED EMBODIMENT

Figure 1:
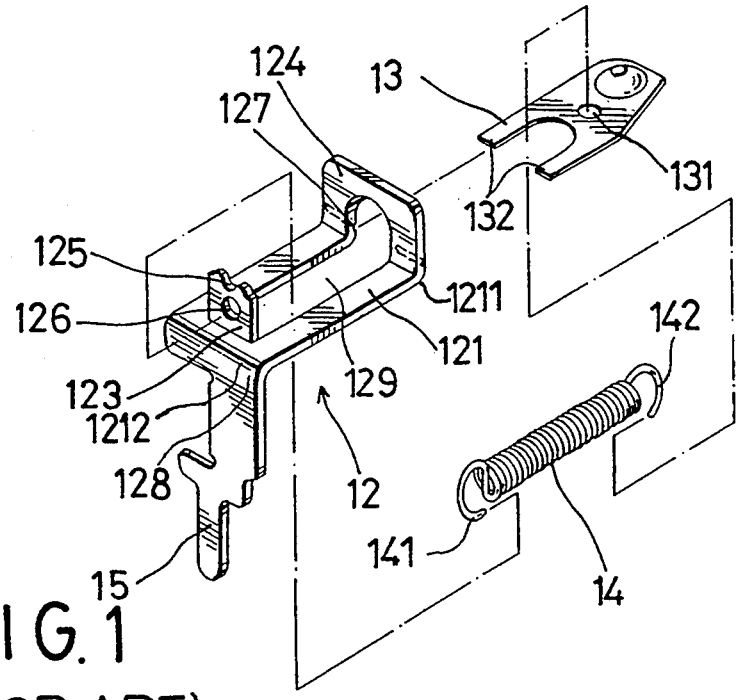
FIG. 1 (PRIOR ART)
FIG. 1 shows the connection relationship among a common conducting unit, a contact plate and a tension spring which are to be employed in a contact switch.
Figure 2:
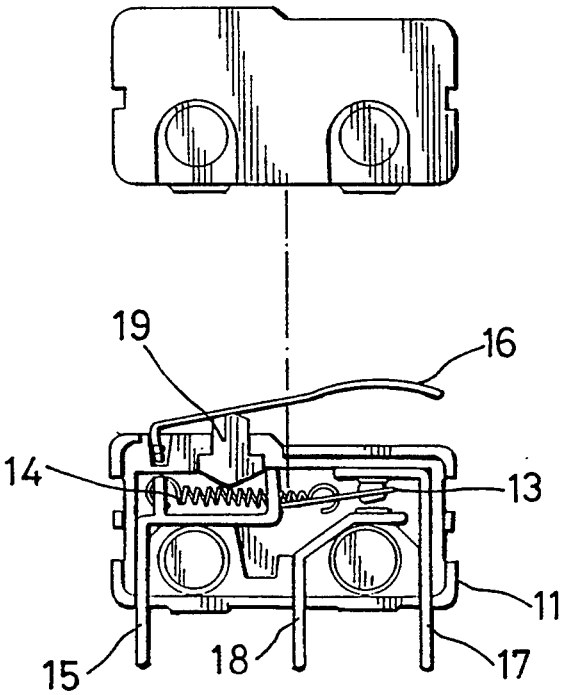
FIG. 2 (PRIOR ART)
FIG. 2 shows the conventional common conducting unit when employed in a contact switch.

Before the present invention is described in greater detail, it should be noted that like elements are indicated by the same reference numerals through out the disclosure.

Since the present invention is related to the conventional common conducting unit of the contact switch described earlier, only the characterizing parts will be detailed in the succeeding paragraphs.

Figure 3:
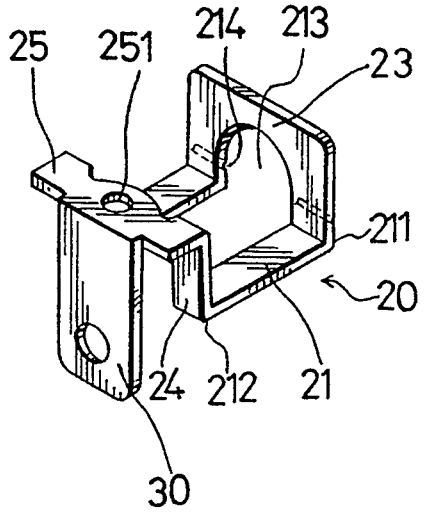
FIG. 3 is a perspective, schematic view of a preferred embodiment of a common conducting unit of the present invention which is to be employed in a contact switch.

Referring to FIG. 3, the common conducting unit of the present invention is to be employed in a contact switch and includes a mounting plate 20 that has an elongated flat portion 21 with two parallel end edges 211, 212, first and second end plate portions 23, 24 that extend integrally and perpendicularly from a respective one of the parallel end edges 211, 212 in the same direction so as to define a pair of opposed faces, a pair of outward faces and a pair of end edges. The outward face of the first end plate portion 23 has an engaging groove 214 which is formed therein and which is parallel with the end edges 211, 212 of the elongated flat portion 21. A spring mounting portion 25 extends integrally and perpendicularly from the end edge of the second end plate portion 24 and forms an end edge therewith. The spring mounting portion 25 has an engaging hole 251 formed therethrough. The mounting plate 20 further has a through-opening 213 which is formed therethrough and which extends from a position adjacent to the end edge of the first plate portion 23 to a position adjacent to the end edge of the second end plate portion 24. In this embodiment, a conducting leg plate 30 extends integrally and perpendicularly from the end edge of the spring mounting portion 25, in a direction opposite to the end plate portions 23, 24.

Figure 6:
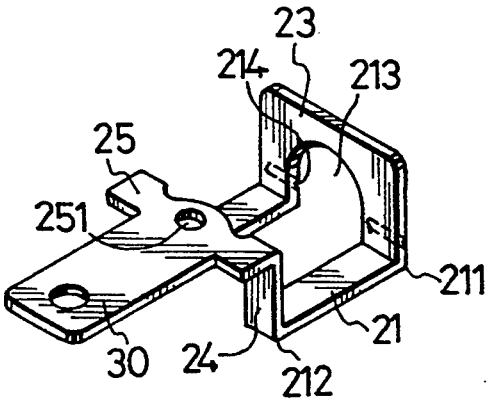
FIG. 6 shows another preferred embodiment of the common conducting unit of the present invention.

Referring to FIG. 6, in another embodiment, the conducting leg plate 30 is formed integrally with the spring mounting portion 25 and extends in the same direction as the latter.

Figure 4:
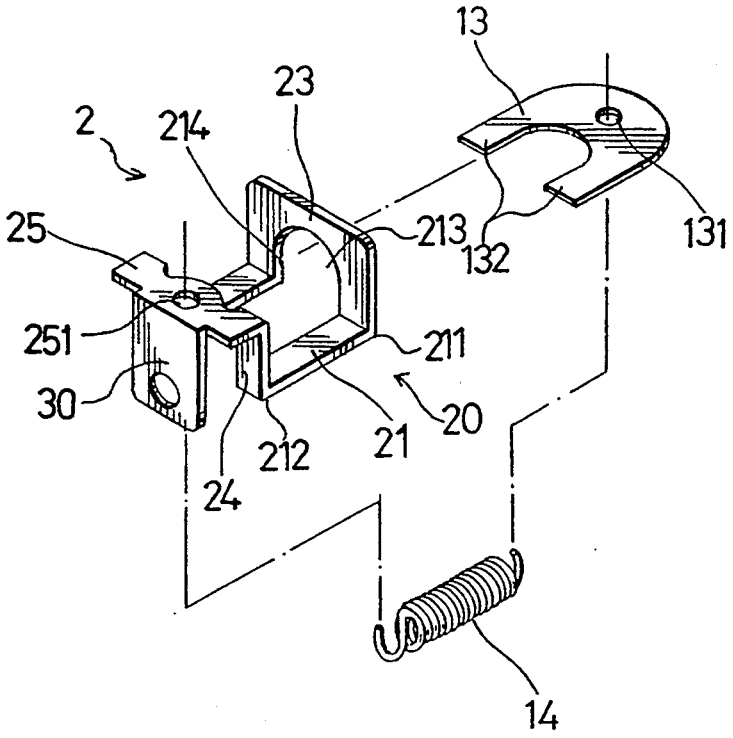
FIG. 4 illustrates the common conducting unit of FIG. 3 shown together with a contact plate and a tension spring.
Figure 5:
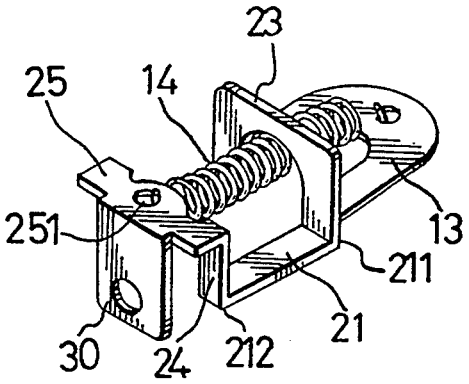
FIG. 5 shows how the common conducting unit of the present invention is connected to the contact plate by the tension spring shown in FIG. 4.

Referring to FIGS. 4 and 5, the common conducting unit 2 of the present invention further includes a contact plate 13 with an engaging opening 131 and has a first end which is provided with two spaced leg portions 132 and which engages pivotally the engaging groove 214 of the first end plate portion 23. A tension spring 14 passes through the first end plate portion 23 via the through-opening 213 to engage the engaging opening 131 and the engaging hole 251 under tension, thereby enabling the spaced leg portions 132 of the contact plate 13 to abut pivotally the first end plate portion 23 of the mounting plate 20 in the engaging groove 214.

The common conducting unit of the present invention is employed in a contact switch. The functions of the conducting leg plate 30 and the contact plate 13 are the same as those described beforehand and thus, a detailed description of which will be omitted herein.

Note that from the above illustration, the engaging hole 251 of the spring mounting portion 25 and the engaging opening 131 of the contact plate 13 are oriented in the same orientation, thereby permitting easy mounting of the tension spring 14 so that full automation of the mounting process is facilitated. The feature and objective of the present invention is thus achieved.

While preferred embodiments have been described and explained, it will be apparent that many changes and modifications can be made in the general construction and arrangement of the present invention without departing from the scope and spirit thereof. Therefore, it is desired that the present invention be not limited to the exact disclosure but only to the extent of the appended claims.

I claim:

1. A common conducting unit for a contact switch comprising:

a mounting plate having an elongated flat portion with two parallel first and second end edges, first and second end plate portions each extending integrally and perpendicularly from each of a respective one of said first and second end edges in a same direction, thereby forming a pair of opposed faces, a pair of outward faces and a pair of end edges thereon, said outward face of said first end plate portion having an engaging groove formed therein and being parallel with said first and second parallel end edges of said elongated flat portion, and a spring mounting portion extending integrally, outwardly and perpendicularly from said end edge of said second end plate portion and forming an end edge therewith, a spring engaging hole extending through said spring mounting portion, said mounting plate further having a through-opening which extends from a position adjacent to said end edge of said first end plate portion to a position adjacent to said end edge of said second end plate portion;

a conducting leg plate extending integrally from said end edge of said spring mounting portion; and a contact plate having a first end with a pair of spaced leg portions engaged in said engaging groove of said first end plate portion, and a spring engaging opening extending through said contact plate in the same orientation as said spring engaging hole in said spring mounting portion; and a tension spring having first and second ends passing through said first end plate portion via said through-opening and having said first end connected to said spring engaging hole and said second end connected to said spring engaging opening to interconnect said contact plate and said spring mounting portion under tension.

2. The common conducting unit as defined in claim 1, wherein said conducting leg plate extends perpendicularly from said end edge of said spring mounting portion in a direction opposite to that of said end plate portions of said mounting plate.

3. The common conducting unit as defined in claim 1, wherein said conducting leg plate extends from said end edge of said spring mounting portion in a direction similar to that of said spring mounting portion.

* * * * *

UNITED STATES PATENT AND TRADEMARK OFFICE

CERTIFICATE OF CORRECTION

PATENT NO. : 5,432,311

DATED : July 11, 1995

INVENTOR(S) : Ching-Chuan LIN

It is certified that error appears in the above-indentified patent and that said Letters Patent is hereby corrected as shown below:

On cover page, item [75], "Inventor", after "City," insert ---Taiwan---.

Signed and Sealed this

Ninth Day of July, 1996

Bruce Lehman

*Attest:*

BRUCE LEHMAN

*Attesting Officer*

*Commissioner of Patents and Trademarks*